US007374425B1

(12) United States Patent
Kuo et al.

(10) Patent No.: US 7,374,425 B1
(45) Date of Patent: May 20, 2008

(54) FOLDABLE POWER SUPPLY DEVICE

(75) Inventors: Ming-Chou Kuo, Chung Ho (TW); Yi-Ching Lin, Chung Ho (TW); Jung-Hui Hsu, Chung Ho (TW)

(73) Assignee: Powertech Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 11/797,780

(22) Filed: May 8, 2007

(30) Foreign Application Priority Data

Mar. 15, 2007 (TW) ..... 96108897 A

(51) Int. Cl.
*H01R 25/00* (2006.01)

(52) U.S. Cl. ..... 439/31; 439/652; 439/640

(58) Field of Classification Search ..... 439/31, 439/652, 640, 11, 654
See application file for complete search history.

(56) References Cited

U.S. PATENT DOCUMENTS 2,305,101 A * 12/1942 O'Brien ..... 439/4
4,975,062 A * 12/1990 Evans et al. ..... 439/13
6,074,243 A * 6/2000 Edwards ..... 439/504
6,296,522 B1 * 10/2001 Ho ..... 439/640
6,728,557 B1 * 4/2004 Tracy et al. ..... 455/575.3
6,780,038 B1 * 8/2004 Huang ..... 439/224
6,786,734 B2 * 9/2004 Yu ..... 439/11
6,991,467 B1 * 1/2006 Cheng et al. ..... 439/10
7,121,852 B2 * 10/2006 Ng et al. ..... 439/131
7,247,028 B2 * 7/2007 Schriefer ..... 439/11
7,264,514 B2 * 9/2007 Hsu et al. ..... 439/640

* cited by examiner

*Primary Examiner*—Gary F. Paumen
(74) *Attorney, Agent, or Firm*—Rosenberg, Klein & Lee

(57) ABSTRACT

A foldable power supply device includes a first socket, a second socket, and a pivoting unit. The first socket has multiple sets of first plugging holes and first conductive plates. The second socket has multiple sets of second plugging holes and second conductive plates. The pivoting unit is located between the first socket and the second socket. The direction of the rotation shaft of the pivoting unit is not parallel to the plugging direction of the first plugging holes and the second plugging holes. Thereby, the foldable power supply device can be opened into a block type to lower its height and be used as a multi-hole type. Alternatively, the device can also be folded to become a vertical type so that one side of the device can align with the wall, and the plugs or the transformers can be plugged into the device in two face-to-face directions.

10 Claims, 5 Drawing Sheets

FOLDABLE POWER SUPPLY DEVICE

BACKGROUND OF THE INVENTION

1. Field of the Invention

The present invention relates to a foldable power supply device. In particular, this invention relates to a power supply device that supplies electrical power to an electrical appliance.

2. Description of the Related Art

Sockets are usually used for supplying electrical power to electrical appliances. Because electric appliances are such a common part of modern life, sockets are necessary devices, and sockets are continuously improved to make their functions more complete.

The socket of the prior art is foldable. The socket can be closed or opened according to requirements. It is convenient for the user. Taiwan patent TW 549707, issued on 21 Aug. 2003, discloses a foldable socket. The foldable socket includes a first socket and a second socket. At one end of the first socket, two shaft covers extend upwards and downwards. The two shaft covers can be covered by each other. On the inner circular of the two shaft covers, there is a protruding edge. At one end of the second socket, a shaft ring extends and the shaft ring covers into the protruding edge of the shaft cover. Thereby, the upper shaft cover and the lower shaft cover of the first socket clips the shaft and are pivoted with the shaft ring of the second socket so that the socket can fit into the shape of a wall corner or edge and be placed.

Although the foldable socket can be closed or opened according to requirements, it is still has some problems. Because the direction of the rotation shaft of the first and second sockets is parallel to the plugging direction of the plugging holes of the first socket and the second socket, all the plugging directions of the plugging holes of the first and second sockets are the same when the foldable socket is closed or opened to any angle. Therefore, all plugs can merely be plugged into the plugging holes of the socket in the same direction, the plugs or the transformers interfere with each other, and the socket cannot be used in a vertical manner.

SUMMARY OF THE INVENTION

One particular aspect of the present invention is to provide a foldable power supply device. The foldable power supply device can be opened to become a block type to lower the height and be used as a multi-hole type. The foldable power supply device can also be closed to become a vertical type so that one side of the foldable power supply device can align with the wall. The plugs or the transformers can be plugged into the foldable power supply device in two face-to-face directions. The problem of the plugs or the transformers interfering with each other is overcome.

The foldable power supply device includes a first socket having multiple sets of first plugging holes, a second socket having multiple sets of second plugging holes, a pivoting unit located between the first socket and the second socket. In the first socket, there is a plurality of first conductive plates. In the second socket, there is a plurality of second conductive plates. The direction of the rotation shaft of the pivoting unit is not parallel to the plugging direction of the first plugging holes and the second plugging holes.

The present invention has the following effects. When the area is large or a lot of plugs need to be plugged into the socket, the foldable power supply device can be opened to become a block type to lower the height and be used as a multi-hole type. When the area is small or just a few plugs need to be plugged into the socket, the foldable power supply device can also be folded to become a vertical type so that one side of the foldable power supply device can align with the wall, and the plugs or the transformers can be plugged into the foldable power supply device in two face-to-face directions. The problem of the plugs or transformers interfering with each other is avoided.

For further understanding of the invention, reference is made to the following detailed description illustrating the embodiments and examples of the invention. The description is only for illustrating the invention and is not intended to be considered limiting of the scope of the claim.

BRIEF DESCRIPTION OF THE DRAWINGS

The drawings included herein provide a further understanding of the invention. A brief introduction of the drawings is as follows.

DETAILED DESCRIPTION OF THE PREFERRED EMBODIMENTS

Figure 1:
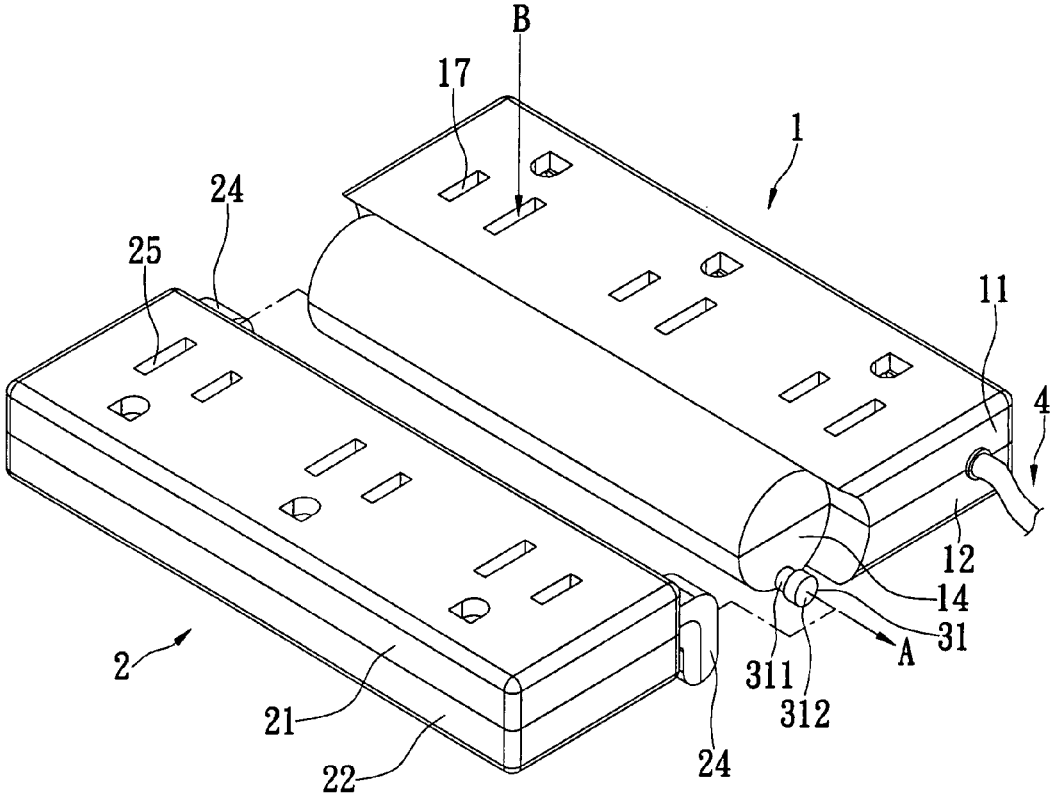
FIG. 1 is an exploded perspective view of the foldable power supply device of the present invention.
Figure 2:
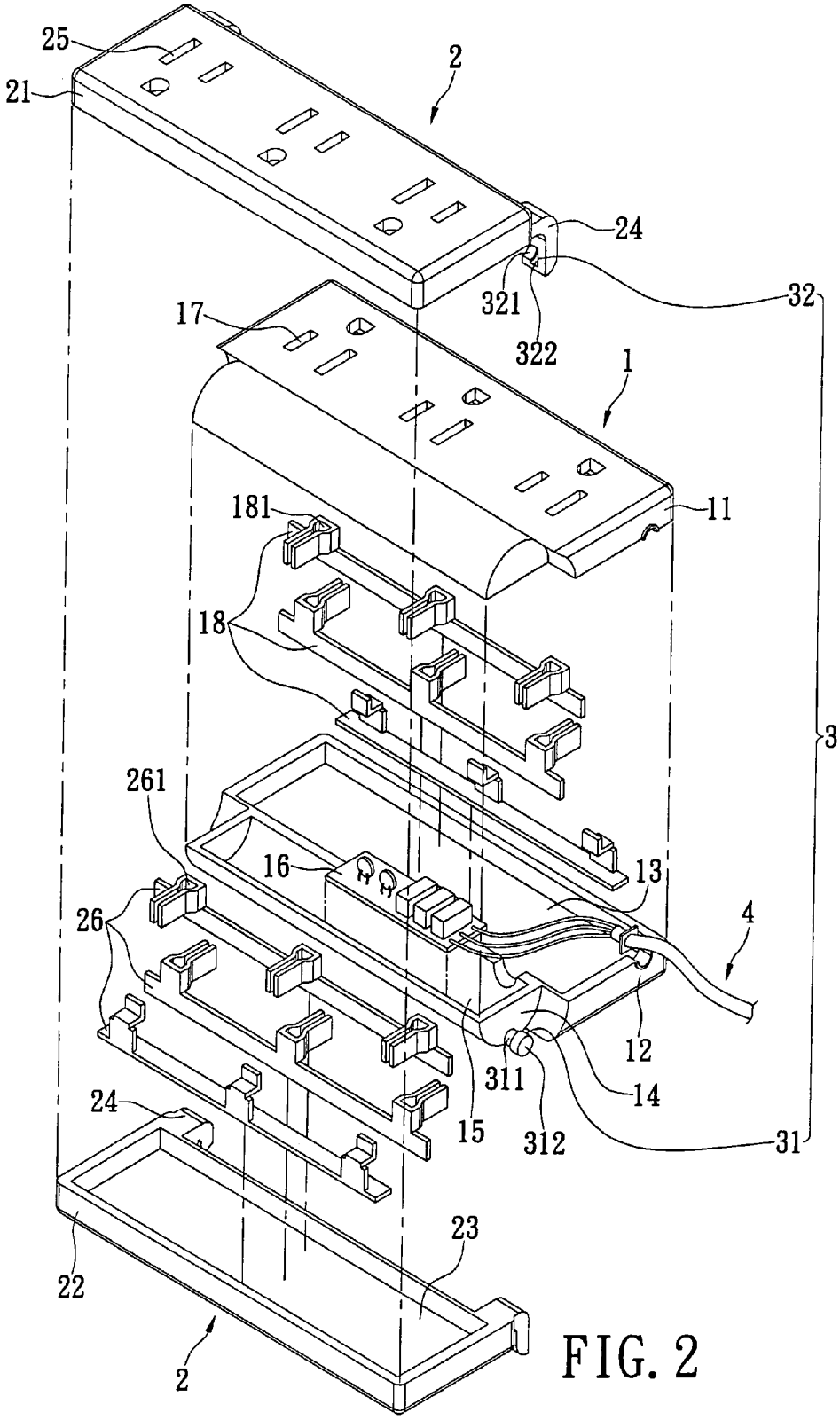
FIG. 2 is another exploded perspective view of the foldable power supply device of the present invention.
Figure 3:
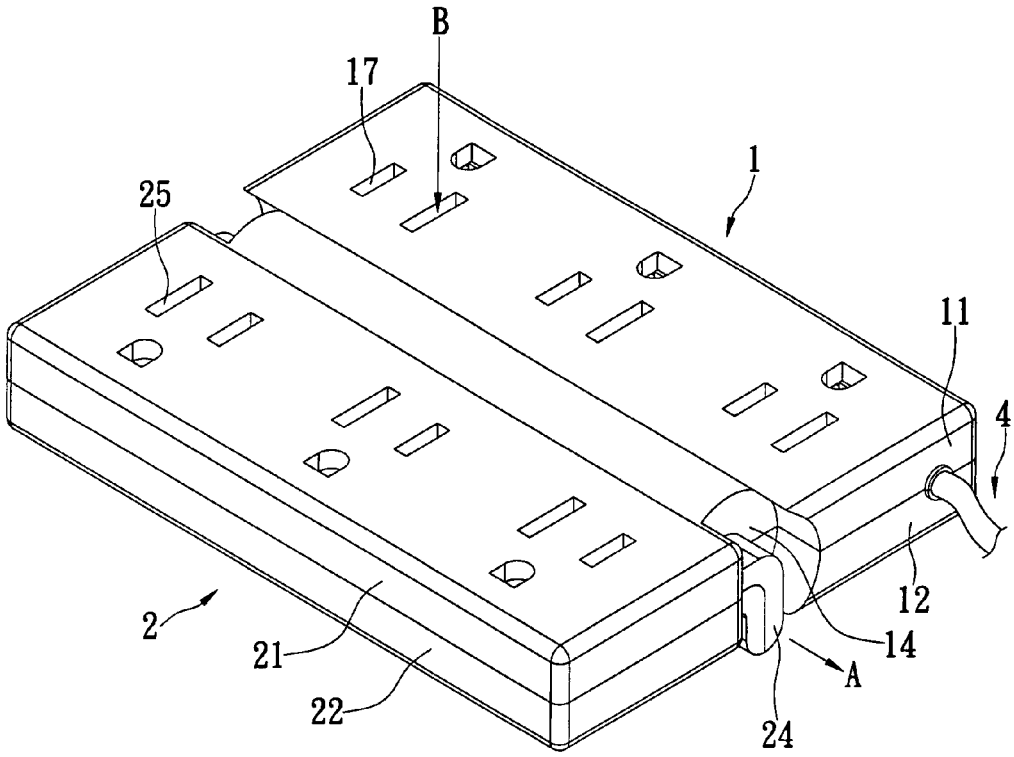
FIG. 3 is a perspective view of the foldable power supply device of the present invention.

Reference is made to FIGS. 1~3. The foldable power supply device includes a first socket 1, a second socket 2, a pivoting unit 3, and a conductive wire 4. The first socket 1 includes a first upper cover 11, and a first lower cover 12. The first upper cover 11 and the first lower cover 12 are combined into one piece via a wedging method or a screwing method to form the hollow first socket 1. In an interior of the first socket 1, there is a first receiving space 13.

On one longer side of the first socket 1, there is a first pivoting portion 14. In an interior of the first pivoting portion 14, there is a second receiving space 15. There is a circuit board 16 in an interior of the second receiving space 15. The conductive wire 4 is electrically connected with the circuit board 16. On the circuit board 16, there is a surge protecting circuit (not shown in the figure). The surge protecting circuit forms a surge protecting algorithm to prevent surges from occurring.

On the first upper cover 11 of the first socket 1, there are multiple sets of first plugging holes 17. The sets of first plugging holes 17 are located on the top of the first upper cover 11. The format and the type of the sets of first plugging holes 17 are not limited to a specific one. In the interior of the first receiving space 13 of the first socket 1, there is plurality of first conductive plates 18. The plurality of first conductive plates 18 are made of conductive materials, such as copper. On the first conductive plate 18, there is a first contacting portion 181 that corresponds to the first plugging hole 17. Therefore, the first contacting portion 181 is electrically connected with the plugging pin of the plug. The first conductive plate 18 is electrically connected with the circuit board 16.

When the plug of the electric appliance is plugged into the first plugging hole 17 of the first socket 1, the plug is electrically connected with the conductive wire 4 via the first conductive plate 18 and the circuit board 16, and electrical power is delivered to the first conductive plate 18 through the conductive wire 4 and the circuit board 16. Thereby, the electric appliance plugged with the first socket 1 acquires the required power.

The second socket 2 includes a second upper cover 21, and a second lower cover 22. The second upper cover 21 and the second lower cover 22 are combined into one piece via a wedging method or a screwing method to form the hollow second socket 2. In an interior of the second socket 2, there is a second receiving space 23. On one longer side of the second socket 2, there are two second pivoting portions 24 that are adjacent to two ends of the longer side of the second socket 2. The two second pivoting portions 24 are individually adjacent to two ends of the first pivoting portion 14.

On the second upper cover 21 of the second socket 2, there are multiple sets of second plugging holes 25. The sets of second plugging holes 25 are located at the top of the second upper cover 11. The format and the type of the sets of second plugging holes 25 are not limited to a specific one. In the interior of the second receiving space 23 of the second socket 2, there is plurality of second conductive plates 26. The plurality of second conductive plates 26 are made of conductive materials, such as copper. On the second conductive plate 26, there is a second contacting portion 261 that corresponds to the second plugging hole 25. Therefore, the second contacting portion 261 is electrically connected with the plugging pin of the plug. The second conductive plate 26 is electrically connected with the circuit board 16.

When the plug of the electric appliance is plugged into the second plugging hole 25 of the second socket 2, the plug is electrically connected with the conductive wire 4 via the second conductive plate 26 and the circuit board 16, and electrical power is delivered to the second conductive plate 26 through the conductive wire 4 and the circuit board 16. Thereby, the electric appliance plugged with the second socket 2 acquires the required power.

The pivoting unit 3 is located between the first pivoting portion 14 of the first socket 1 and the second pivoting portion 24 of the second socket 2. The structure of the pivoting unit 3 is not limited to any specific one. Any type that can pivot the first socket 1 with the second socket 2 is within the scope of the present invention. In this embodiment, the pivoting unit 3 includes two rotating shafts 31 and two shaft holes 32. The two rotating shafts 31 protrude from two ends of the first pivoting portion 14. Each of the two rotating shafts 31 has a shaft portion 311. The shaft portion 311 is a column. One end of the shaft portion 311 is connected with the first pivoting portion 14 and is integrated into one piece. Another end of the shaft portion 311 is connected with a head portion 312. The outer diameter of the head portion 312 is larger than the outer diameter of the shaft portion 311.

The two shaft holes 32 are located on the two second pivoting portions 24. Each of the two shaft holes 32 has a small hole portion 321 and a big hole portion 322. The inner diameter of the big hole portion 322 is larger than the inner diameter of the small hole portion 321. The small hole portion 321 and the big hole portion 322 individually correspond to the shaft portion 311 and the head portion 312. The shaft portion 311 and the head portion 312 of the two rotating shafts 31 respectively and rotatably fit with the small hole portion 321 and the big hole portion 322 of the two shaft holes 32 to prevent the two rotating shafts 31 from moving axially. The first sock 1 is pivoted with the second socket 2 via the pivoting unit 3. The direction A of the rotating axis of the pivoting unit 3 is not parallel to the plugging direction B of the first plugging hole 17 and the second plugging hole 25.

The foldable power supply device is a multi-hole socket. The plugging holes 17, 25 are divided into two groups by the pivoting unit 3. Therefore, the total length of the foldable power supply device is not too long due to the plugging hole with a European format.

When the area is large or a lot of plugs need to be plugged into the socket, the foldable power supply device can be opened to become a block type (as shown in FIG. 3) to lower the height and be used as a multi-hole type.

Figure 4:
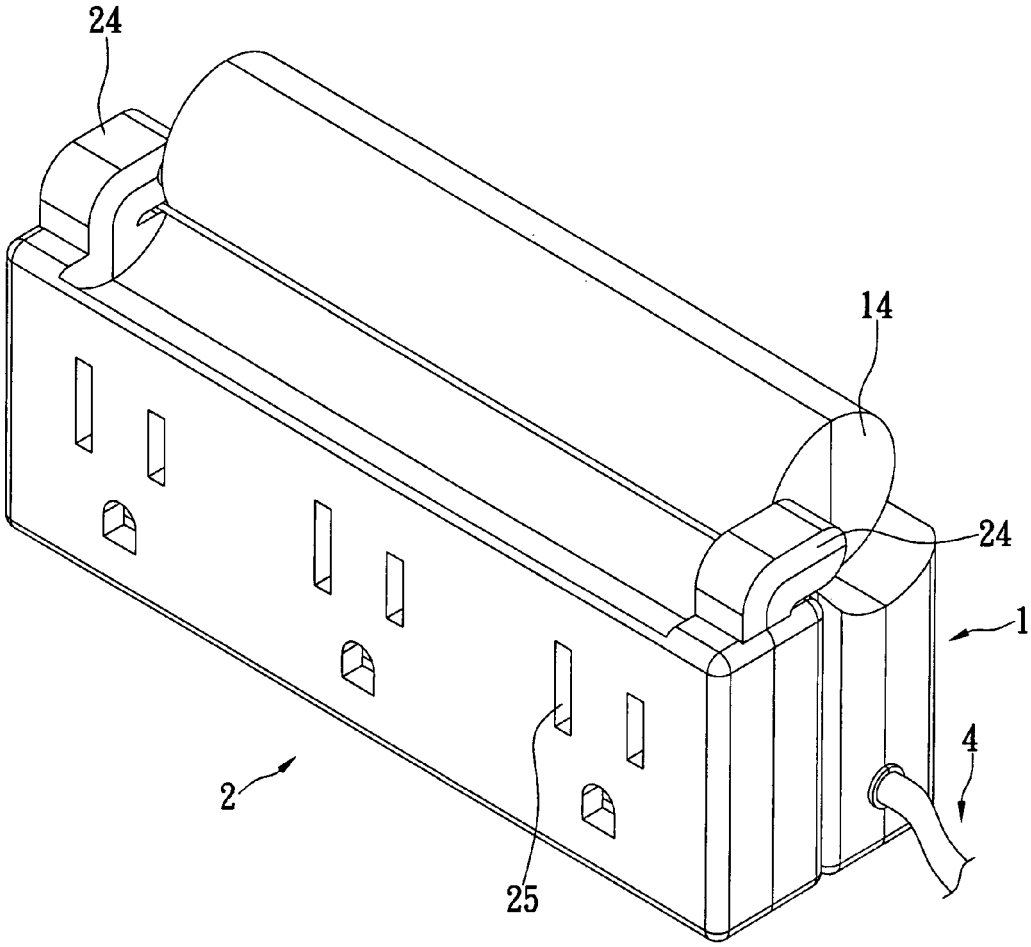
FIG. 4 is a perspective view of the foldable power supply device of the present invention on another usage status.

When the area is small or just a few plugs need to be plugged into the socket, the foldable power supply device can also be folded to become a vertical type (as shown in FIG. 4) so that one side of the foldable power supply device can align with the wall. On the other side, the plugs or the transformers can be plugged into the foldable power supply device in two face-to-face directions when the foldable power supply device is folded into a vertical type.

When the foldable power supply device is folded into a vertical type, the user can exert a force to the opening A (as shown in FIG. 4) to open the foldable power supply device into a block type.

Figure 5:
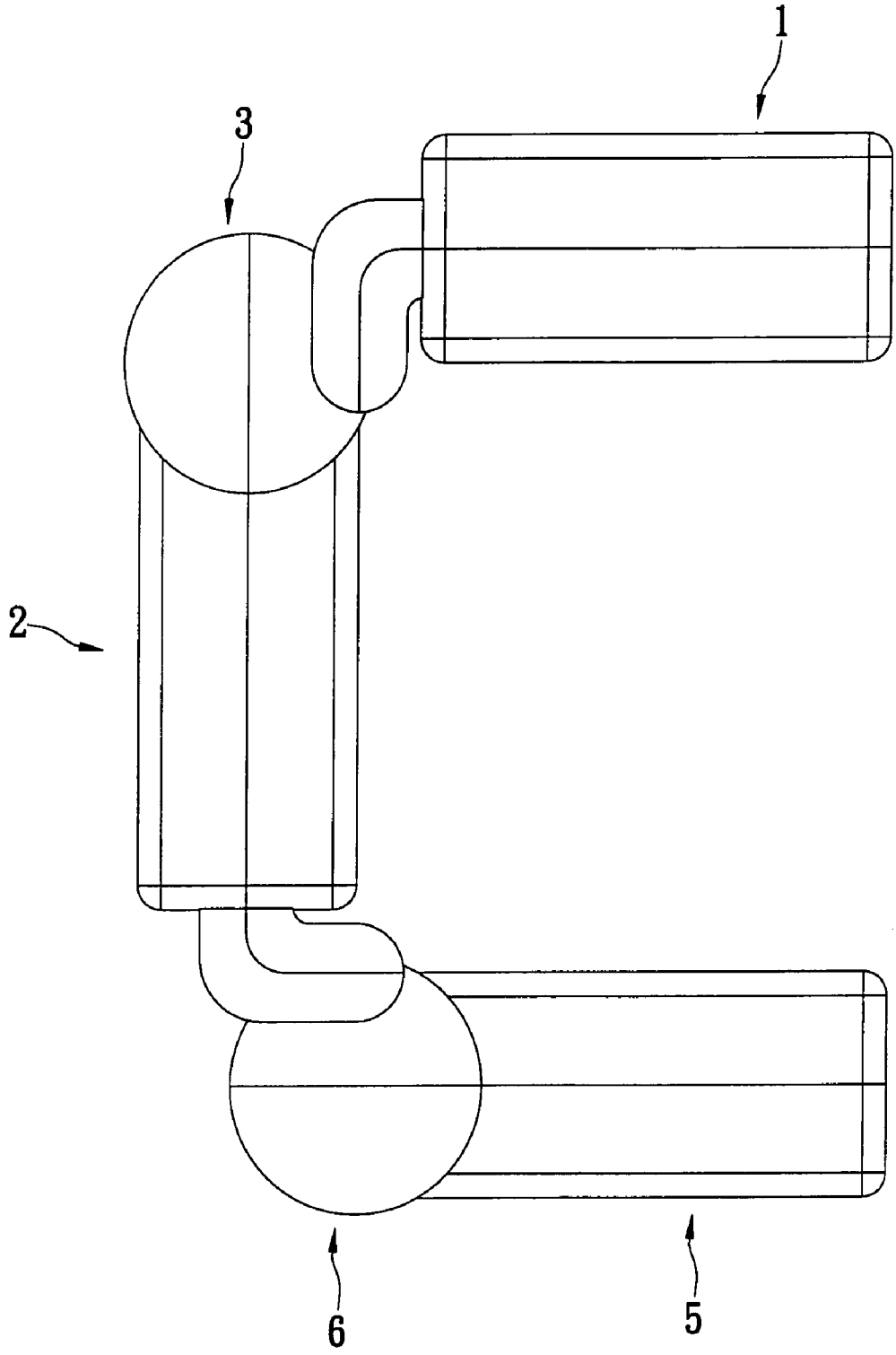
FIG. 5 is a side view of the foldable power supply device of the second embodiment of the present invention.

Furthermore, reference is made to FIG. 5. The present invention further includes a third socket 5. The third socket 5 is pivoted with one side of the second socket 2 by another pivoting unit 6 so that the foldable power supply device has a U-shape. The first socket 1, the second socket 2, and the third socket 5 can be opened to any angle. Alternatively, the first socket 1, the second socket 2, and the third socket 5 can be folded into a U-shape that can clip one side of a table.

The description above only illustrates specific embodiments and examples of the invention. The invention should therefore cover various modifications and variations made to the herein-described structure and operations of the invention, provided they fall within the scope of the invention as defined in the following appended claims.

What is claimed is:

1. A foldable power supply device, comprising:

a first socket having multiple sets of first plugging holes, wherein the there is a plurality of first conductive plates in the first socket;

a second socket having multiple sets of second plugging holes, wherein there is a plurality of second conductive plates in the second socket; and a pivoting unit located between the first socket and the second socket, wherein the direction of the rotation shaft of the pivoting unit is not parallel to the plugging direction of the first plugging holes and the second plugging holes.

2. The foldable power supply device as claimed in claim 1, wherein the first socket includes a first upper cover, and a first lower cover, the first upper cover and the first lower cover are combined into one piece, and the first plugging holes are located on the first upper cover.

3. The foldable power supply device as claimed in claim 1, wherein there is a first receiving space in an interior of the first socket, and the first conductive plates are received in the first receiving space.

4. The foldable power supply device as claimed in claim 1, wherein there is a first pivoting portion on a longer side of the first socket, there is a second pivoting portion on a longer side of the second socket, and the pivoting unit is located between the first pivoting portion and the second pivoting portion.

5. The foldable power supply device as claimed in claim 1, wherein there is a first receiving space in the interior of the first socket, a circuit board is received in the receiving space, and the first conductive plates and the second conductive plates are electrically coupled to the circuit board.

6. The foldable power supply device as claimed in claim 1, wherein there is a plurality of contacting portions on the first conductive plates that correspond to the first plugging holes.

7. The foldable power supply device as claimed in claim 1, wherein the second socket includes a second upper cover, and a second lower cover, the second upper cover and the second lower cover are combined into one piece, and the second plugging holes are located on the second upper cover.

8. The foldable power supply device as claimed in claim 1, wherein there is a second receiving space in an interior of the second socket, and the second conductive plates are received in the second receiving space.

9. The foldable power supply device as claimed in claim 1, wherein the pivoting unit includes two rotating shafts and two shaft holes, the two rotating shafts protrude from the first pivoting portion, each of the two rotating shafts has a shaft portion, one end of the shaft portion is connected with a head portion, the two shaft holes are located on the second socket, each of the two shaft holes has a small hole portion and a big hole portion, and the shaft portions and the head portions of the two rotating shafts respectively and rotatably fit with the small hole portion and the big hole portion of the two shaft holes.

10. The foldable power supply device as claimed in claim 1, further comprising a third socket, wherein the third socket is pivoted with one side of the second socket via another pivoting unit.

* * * * *